United States Patent [19]

Masui

[11] Patent Number: 4,725,461

[45] Date of Patent: Feb. 16, 1988

[54] COMBINATION OF ARTIFICIAL-FLOWER-FORMING RIBBON AND TACK PLATE

[75] Inventor: Kosuke Masui, Aichi, Japan

[73] Assignee: Kabushiki Kaisha Aoyama, Nagoya, Japan

[21] Appl. No.: 929,555

[22] Filed: Nov. 12, 1986

[30] Foreign Application Priority Data

Jun. 2, 1986 [JP] Japan ..... 61-84497[U]
Sep. 1, 1986 [JP] Japan ..... 61-132785[U]

[51] Int. Cl.[4] ..... A41G 1/00; D04D 7/10

[52] U.S. Cl. ..... 428/4; 428/24; 428/101

[58] Field of Search ..... 428/4, 5, 24, 25, 26, 428/101

[56] References Cited

U.S. PATENT DOCUMENTS

| | | | |
|---|---|---|---|
| 3,630,810 | 12/1971 | Mauro | 428/5 |
| 4,476,167 | 10/1984 | Duftler | 428/4 |
| 4,476,168 | 10/1984 | Aoyama | 428/4 |
| 4,585,676 | 4/1986 | DeSmet et al. | 428/5 |
| 4,634,612 | 1/1987 | Nelson et al. | 428/4 |

*Primary Examiner*—Henry F. Epstein

*Attorney, Agent, or Firm*—Schwartz & Weinrieb

[57] ABSTRACT

A combination of an artificial-flower-forming ribbon and a tack plate, wherein the artificial-flower-forming ribbon having a pair of strips overlapped with respect to each other and at least one string placed along and between the strips, the string being joined to one end of each of the strips at one end thereof, the strips being adhered to each other at least at two portions on each of a plurality of lines spaced apart in the longitudinal direction of the strips so as to permit relative movement of the strips and string placed between the strips. The tack plate includes a first plate member having at least one slit or hole, through which both of the strips and string are passed, and a second plate member having adhesive films on both surfaces thereof. The second plate member is joined at one surface thereof to the first plate member and one of the strips passed through the slit or hole of the first plate member. The tack plate can also be formed by a single plate member having at least one slit or hole, through which both of the strips and string or only the string are passed, and an adhesive film on one surface thereof. An artificial flower is fastened to an article or a wrapping thereof through means of the tack plate.

20 Claims, 20 Drawing Figures

COMBINATION OF ARTIFICIAL-FLOWER-FORMING RIBBON AND TACK PLATE

BACKGROUND OF THE INVENTION

1. Field of the Invention

This invention relates to a combination of a ribbon for forming an artificial flower and a tack plate for fastening the ribbon, formed into the artificial flower to an article or a wrapping thereof or the like.

2. Description of the Prior Art

As is often the case, an artificial flower is attached to an article or a wrapping thereof to decorate for gift-giving.

There has been heretofore proposed a ribbon for forming an artificial flower used for such purpose (Utility Model Publication (Kokoku) No. 14726/1985). The conventional artificial-flower-forming ribbon has a pair of strips overlapped with respect to each other and a pair of strings placed along and between the strips. One end of each of the strings is joined to one end of each of the strips. Both strips are joined to each other at least at two portions on each of a plurality of lines spaced apart in the longitudinal direction of the strips so as to permit relative movement of the strips and the strings disposed in the longitudinal direction of the strips.

According to the artificial-flower-forming ribbon noted above, the ribbon can be formed into an artificial flower by causing the relative movements of the pair of strips and the strings in the longitudinal direction of the ribbon. For example, when causing the relative movement of the strips and the strings by holding lightly the other end of the ribbon is one hand while drawing the other ends of the strings between both strips by the other hand, both strips bend outwardly between a plurality of adhesive portions thereof. Each bent strip forms a petal of the artificial flower.

The artificial flower thus formed is fastened to an article for gift-giving or a wrapping accommodating the article therein or the like (hereinafter referred to as article or the like), by tying the other ends of the strings, extending outwardly from the other ends of the strips, around the article or the like forming or pasting the artificial flower thereon. However, such means of fastening the artificial flower is not always carried out skillfully by anyone or at any time. Therefore, the skill in fastening results in an extreme difference in the decoration effect of the article or the like.

OBJECT OF THE INVENTION

It is an object of the present invention to provide a combination of an artificial-flower-forming ribbon and a fastening means thereof, which enables anyone at any time to attach the flower-ribbon on an article or the like skillfully and decently.

SUMMARY OF THE INVENTION

According to the present invention, there is provided a combination of an artificial-flower-forming ribbon having a pair of strips overlapped with respect to each other and at least one string placed along and between the strips and a tack plate, wherein one end of the string is joined to one end of each of the strips, the strips are joined with each other at least at two portions of each of a plurality of lines spaced apart in the longitudinal direction of the strips so as to permit relative movement of the strips and the string placed between the strips, and the tack plate includes a first plate member having at least a slit or a hole, through which both of the strips and string are passed, and a second plate member having adhesive films on both surfaces thereof, the second plate member being joined at one surface thereof to the first plate member and one of the strips being passed through the slit or hole of the first plate member.

According to the present invention, the ribbon is integrally coupled with the tack plate by passing the ribbon through the first plate member of the tack plate and pressing the second plate member having the adhesive films on the both surfaces against the first plate member. The tack plate is preferably placed at the other end of the ribbon. The ribbon coupled with the tack plate can be fastened to the article or the like before or after the ribbon is formed into the artificial flower. When the other surface of the second plate member of the tack plate is pressed against a predetermined position of the article or the like, the ribbon or artificial flower is fastened to the article or the like due to the presence of the adhesive film provided on the other surface of the second plate member. The artificial flower may be formed by causing the relative movement of both strips of the ribbon and the string in the longitudinal direction.

The present invention is characterized by forming the tack plate by a single plate member having at least a slit or hole, through which both of the strips and string or only the string are passed, and an adhesive film on one surface thereof.

According to the present invention, after the ribbon is passed through the tack plate so as to form the artificial flower, one surface of the tack plate is pressed against the article or the like, thereby fastening the artificial flower to the article or the like. Part of one strip facing one surface of the tack plate is adhered to a corresponding part of the one surface due to the presence of the adhesive film on the one surface. Further, the remaining portion of the one surface is adhered to the article or the like.

When the tack plate is passed over the string, part of the string is partially adhered to the corresponding part of the one surface of the tack plate and the remaining portion of the one surface is adhered to the article or the like by pressing the one surface of the tack plate against the article or the like.

In any of the embodiments noted above, special techniques are not necessary for the attaching operation of the artificial flower which is carried out by pressing the adhesive film of the tack plate against the article or the like. Accordingly, the attaching operation may be carried out very easily by anyone at any time. Further, the artificial flower may be securely attached.

BRIEF DESCRIPTION OF THE DRAWINGS

The above mentioned and other objects and features of the invention will become apparent from the following detailed description taken in conjunction with the drawings which indicate embodiments of the invention, in which.

DESCRIPTION OF THE ILLUSTRATED EMBODIMENTS

Figure 1:
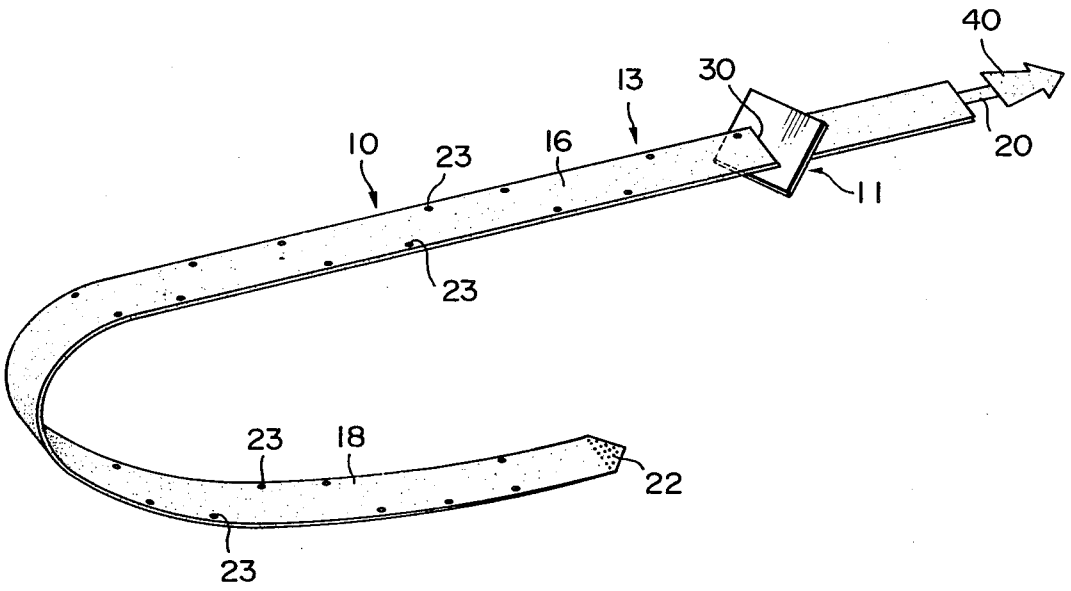
FIGS. 1, 2 and 3 are plan views showing a combination of an artificial-flower-forming ribbon before forming an artificial flower and a tack plate according to the present invention, respectively.
Figure 2:
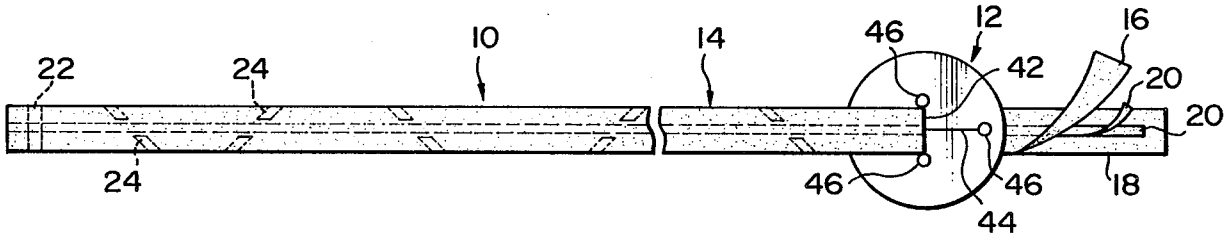
Figure 3:
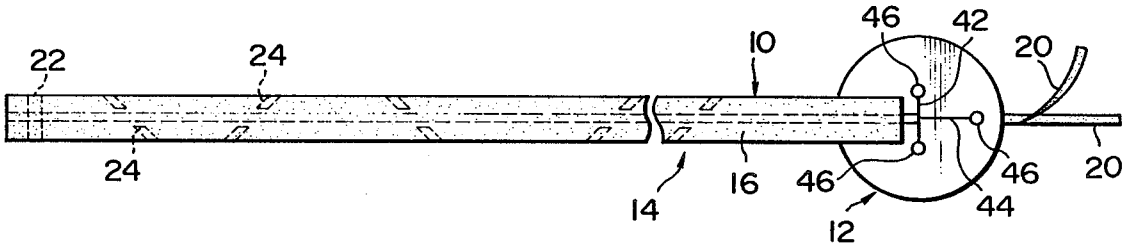

FIGS. 1 to 3 illustrate a combination 13 or 14 of an artificial flower-forming-ribbon 10 before forming an artificial flower and a tack plate 11 or 12 according to the present invention.

The ribbon 10 includes a pair of elongated strips 16, 18 overlapping each other and at least one string 20 placed along and between the strips.

Strips narrower than the width of the strips 16, 18 and having a material similar to that of the strips 16,18 may be used as the string(s). The string(s) 20 is placed in the middle of the strips in the widthwise direction thereof.

Both strips 16, 18 are adhered to each other at joint portions 22 provided at respective ends thereof. Further, the string(s) 20 is (are) adhered at the ends thereof to both strips 16, 18 at the joint portions 22. The strips 16, 18 can be formed by folding back a single strip. In this case, the strips 16, 18 are united at one end. Further, the string(s) 20 may be fixed at the ends thereof to the strips 16, 18.

Further, the strips 16, 18 are adhered to each other at least at two portions on each of a plurality of lines (not shown) spaced apart in the longitudinal direction of the strips. The joint portion in the embodiment shown in FIG. 1 presents a dotted-shape as shown by the reference numeral 23, while the joint portion in the embodiment shown in FIGS. 2 and 3 presents a parallelogrammed-shape as shown by the reference numeral 24. Two joint portions 23, 24 on the respective lines are located within an area except for the middle portion of the strips so as to permit relative movement of the strings 20 with respect to the strips 16, 18 in the longitudinal direction of the strips.

Figure 5:
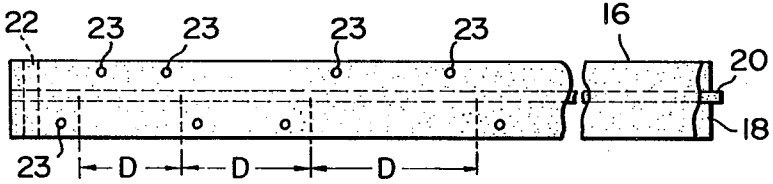
FIGS. 5 and 6 are plan views of the artificial-flower-forming ribbon for explaining the interval between adhesive portions of both strips, respectively.
Figure 6:
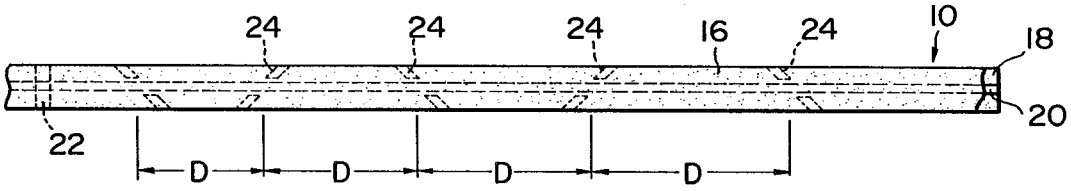

Respective lines on which two joint portions 23, 24 are placed are inclined at a certain angle, for example, at 45° in the embodiment shown in the drawing with respect to the widthwise direction of the strips 16, 18, the inclination of which are alternately reverse. Also, the inclination angle of each line may be set so as to change periodically to two different angles, for example, from 45° to 90°. The inclination angle of each line may be set to a desired one. Therefore, the crossing angle between mutual petals of an artificial flower which will be described later and the phase difference are changed according to the set angle. Further, the distance D between the middle portions of respective lines ajacent to each other (see FIGS. 5 and 6) gradually lengthens from the ends of the strips 16, 18 toward the other ends thereof.

Figure 4:
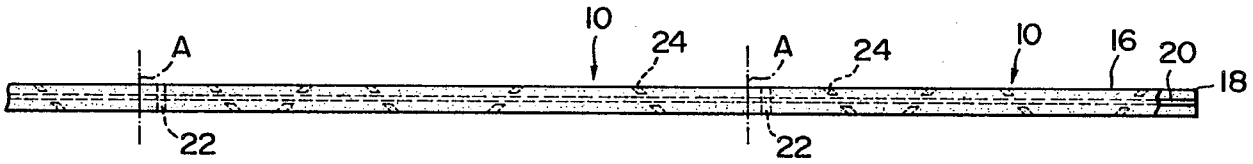
FIG. 4 is a plan view showing a ribbon for successively forming a plurality of artificial flowers before cutting.

As an adhesive for the joint portions 22, 23 and 24, a hot-melt adhesive such as polyvinyl acetate is preferable. Further, by using a heat-adhesion means with at least a pair of heat rollers (not shown) having a die for adhering the joint portions 22, 23 and 24, both strips 16, 18 and the string(s) 20 may be combined by one heat-adhesion process. Further, successive forming of the ribbon is practicable, and after that, a number of ribbons 10 may be efficiently produced by cutting a prescribed portion as shown by A in FIG. 4.

Figure 7:
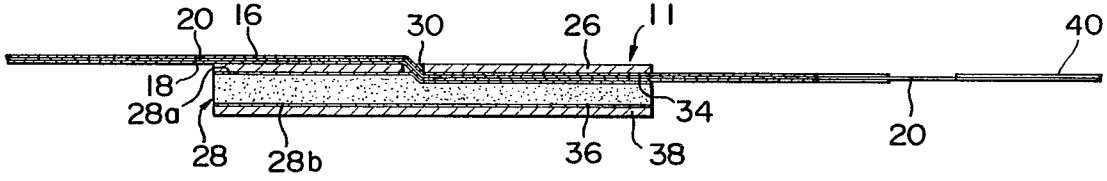
FIG. 7 is a fragmentary longitudinal sectional view showing the combination shown in FIG. 1.

The tack plate 11 shown in FIG. 1 includes a first plate member 26 and a second plate member 28 (see FIG. 7). The first and second plate members 26 and 28 have the same planar shape respectively and are made of paper, plastic, metal or the like.

Figure 8:
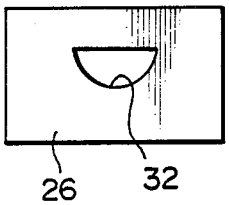
FIGS. 8, 9 and 10 are plan views showing a modification of a first plate member of the tack plate, respectively.
Figure 9:
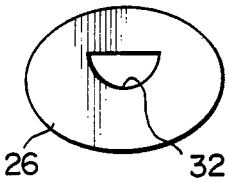

As shown in FIG. 7 in detail, the first plate member 26 has at least a slit 30 or hole 32 (see FIGS. 8 to 10), through which the ribbon, that is, both of the strips 16, 18 and string 20, is passed. The second plate member 28 has adhesive films 34, 36 applied to both surfaces 28*a*, 28*b* respectively. The second plate member 28 is joined at one surface 28*a* to the first plate member 26 and the ribbon 10 is passed through the slit 30 or hole 32 of the first plate member.

The second plate member 28 shown in the drawing is made of an elastic material such as a foam plastic plate and is compressed in the thickness direction thereof by an amount equal to the thickness of the pair of strips 16, 18 and string 20 in the adhesive area in contact with the strip 18. The first plate member 26 and ribbon 10 are integrally coupled to each other by means of the second plate member 28. The tack plate 11 is preferably placed in the neighborhood of the other ends of the pair of strips 16, 18. To the other surface 28*b* of the second plate member 28 having the whole surface capable of adhering to an article, a wrapping thereof or the like, if necessary, is joined a separable sheet 38 covering the film 36, having the planar shape similar to that of the second plate member 28 and made of paper, plastic, metal or the like. The sheet 38 protects the film 36 from damage to the film by deposition of dust or like dusty substances which reduce the adhesion performance thereof.

The ribbon 10 can be formed into an artificial flower by moving the string 20 relatively with respect to the pair of strips 16, 18 in the longitudinal direction thereof, as will be described later. A finger grip 40 is provided at the other end of the string 20. When drawing the finger grip 40 while holding stationary the pair of strips 16, 18, the string 20 is moved relative to strips 16, 18. However, the finger grip 40 may be eliminated if necessary. It is not always required.

Figure 10:
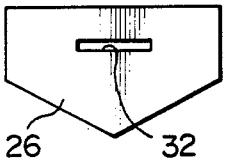

The first plate member 26 may have a desired planar shape, that is, that of a rectangle (FIGS. 1 and 8), an ellipse (FIG. 9) or a pentagon (FIG. 10). The hole 32 may also be selected to have a desired shape such as that of a semicircle (FIGS. 8 or 9) and rectangle (FIG. 10) and formed at a desired position in the first plate member 26.

Figure 11:
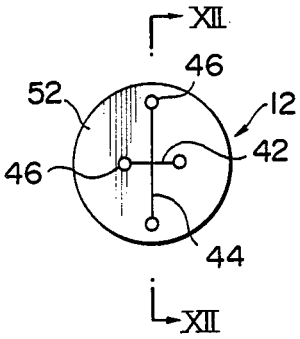
FIGS. 11, 13, 14, 15 and 16 are plan views showing the modification of the tack plate in the combination shown in FIGS. 2 and 3, respectively.
Figure 14:
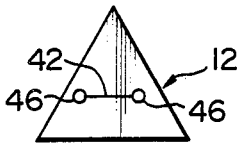
Figure 15:
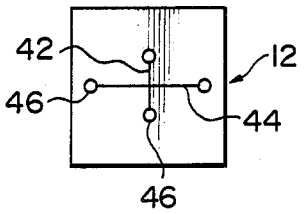

The tack plate 12 as shown in FIGS. 2, 3 and 11 is formed by a single plate member having a circular planar shape and made of paper, plastic, metal or the like. The tack plate 12 may also have a polygonal planar shape such as that of a triangle (FIG. 14) or a rectangle (FIG. 15).

Figure 13:
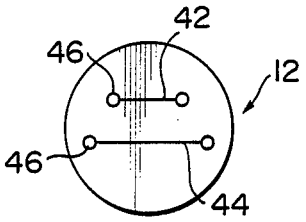

The tack plate 12 is provided with at least one slit 42. The pair of strips 16, 18 of the ribbon 10 and a pair of strings 20 placed between the strips (FIG. 2) or only the pair of strings 20 (FIG. 3) are passed through the slit 42, thereby coupling the ribbon 10 with the tack plate 12. The slit may have a length equal to the width of each of the strips or strings passed therethrough. Further, the length of the slit may be smaller than the width of each of the strips or strings. In this case, the tack plate may not be removable from the strips or strings. Further, the tack plate may be combined with one of a plurality of ribbons having the strips or strings having the width equal to or greater than the length of the slit by the provision of two slits 42, 44 having different lengths respectively and crossing each other as shown in FIGS. 2, 3, 11 and 15 or by the provision of two slits 42, 44 parallel to each other and having the different lengths respectively as shown in FIG. 13. As shown in FIG. 14, the number of slits may be one or three or more (not shown). Further, it is preferable that a die cutting hole 46 communicating respectively with the opposite ends of each slit is provided. The holes 46 prevent the ends of slits 42, 44 from tearing off.

Figure 16:
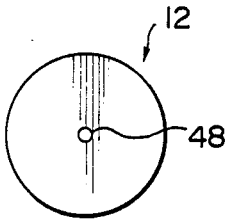
Figure 17:
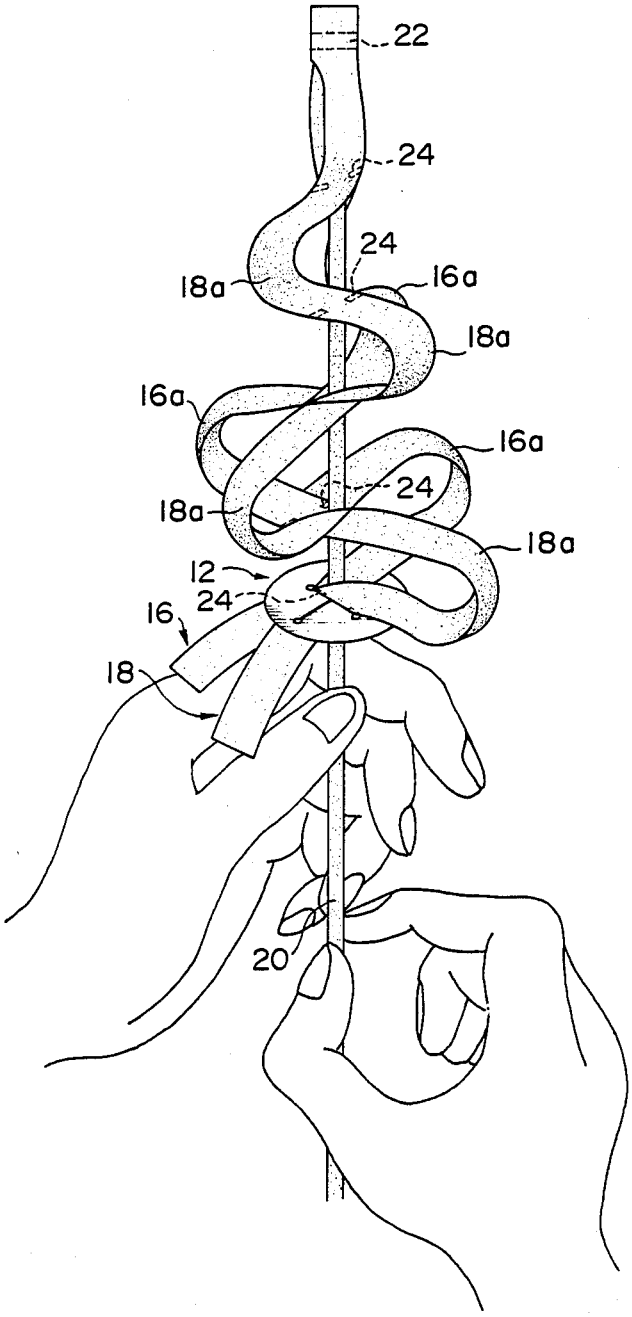
FIG. 17 is a perspective view showing the combination shown in FIG. 2 during the formation of the artificial flower.

Instead of a slit, the aperture may be formed as a rectangular hole (not shown), for example. A circular hole 48 having a diameter equal to or smaller than the width of each of the strings 20 is preferable as a hole for passing the strings 20 therethrough as shown in FIG. 16.

Figure 12:
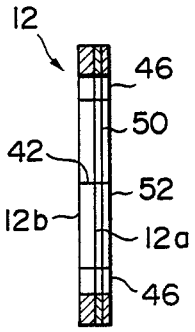
FIG. 12 is a sectional view of the tack plate taken along line XII—XII in FIG. 11.

As is apparent from FIG. 12, an adhesive film 50 is applied to one surface 12*a* of the tack plate 12. A separable sheet 52 for covering the film 50, having the planar shape similar to that of the tack plate 12 and made of paper, plastic, metal or the like is joined to the film 50, if necessary. The sheet 52 acts to protect the film 50 from damage to the film by deposition of dust or like dusty substances which reduce the adhesion performance thereof.

The surface 12*a* of the tack plate 12 may be disposed toward either one of the ends of the strips 16, 18, preferably toward the ends of the strips as in the illustrated embodiment from the standpoint of facilitating the securement of the artificial flower.

Figure 18:
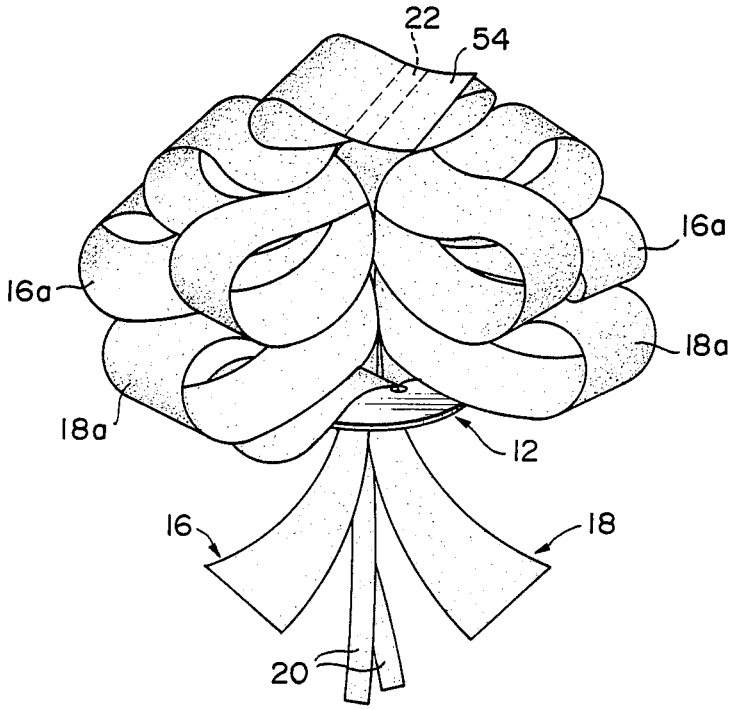
FIG. 18 is a perspective view showing the combination after forming the artificial flower.

The ribbon 10 can be formed into the artificial flower by causing the relative movement of the strips 16, 18 with respect to the strings 20 in the longitudinal direction. For example, the ribbon 10 as shown in FIG. 2 can be formed into the artificial flower by holding the other ends of the strings 20 (or the other ends of the strips 16, 18) at the other surface 12*b* of the tack plate 12 in one hand and drawing the other ends of the strings 20 with the other hand. This causes respective portions 16*a*, 18*a* of the pair of strips 16, 18 between a plurality of line pairs located between the joint portions 24 thereon to bend outwardly with the lines as folded lines. These bent portions 16*a*, 18*a* form petals. Since the petals are oriented by the respective lines with an inclination angle of 45° with respect to the widthwise direction of the strips 16, 18, a set of bent portions 16*a*, 18*a* makes and angle of 90° with respect to each other. Moreover, since the inclination angle of the plurality of lines is alternately reversed, respective petals 16*a*, 18*a* have a phase difference of 90° with respect to each other. As a result, an artificial flower with considerably uniformly distributed petals 16*a*, 18*a* as viewed in cross-section can be speedily formed as shown in FIG. 18.

Further, since the distance D between the respective lines gradually lengthens as mentioned above, from one end of each strip toward the other ends of the strips 16, 18, the petals 16*a*, 18*a* gradually shorten from the base of the flower toward the tip portions 54 of said one ends.

Accordingly, while the distance D may be made equal, the artificial flower looks more natural if the distance D varies so as to increase from the first ends towards the other ends of the strips.

The artificial flower thus formed may be adhered to the surface of an article 56 for securement by directing the film 50 toward the article 56 (in the case of the sheet 52, being present, after peeling off the sheet) and pressing the tack plate 12 placed at the other ends of the strips 16, 18 by one's fingers applies to the other surface 12*b*. At this time, part of one strip 16 is brought into contact with the surface of the article 56 and part of the other strip 18 is adhered to the adhesive film 50. Further, the remaining portion of the film 50 is adhered to the surface of the article 56. As a result of forming a ribbon 14 into the artificial flower, it is preferable that the pair of strings 20 extending from the base of the flower are cut at a proper position prior to or after the securement of the artificial flower. The residual ends of the pair of strings 20 after cutting or the residual portion to be cut is pressed between the other ends of the strips 16, 18 which are disposed thereagainst.

Figure 19:
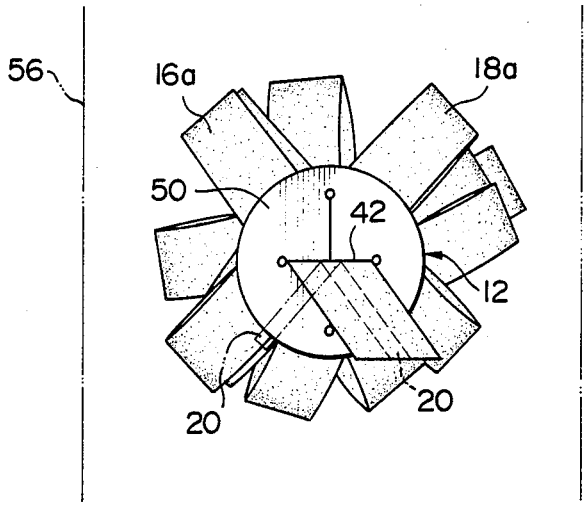
FIGS. 19 and 20 are views showing the artificial flower in the state of being fastened to an article as seen through the article, respectively.

Further, the relative movement of the strips 16, 18 and strings 20 is blocked by frictional forces produced therebetween by pressing the tack plate 12 against the article, thereby maintaining the bent state of said strips constituting the petals of the flower. Accordingly, when an external force greater than the frictional force acts on the artificial flower, the bent state is liable to be partially eliminated. In order to avoid this, it is preferable that when pressing the tack plate 12 against the article, at least one of the strings 20 is pulled laterally out of the portion between the pair of strips 16, 18 (shown by two-dot chain lines in FIG. 19), or the other strip 18 is folded back (not shown) so as to expose the strings 20 to attach one or both strings 20 to the film 50 of the tack plate together with the other strip 18, thereby completely blocking the relative movement.

Figure 20:
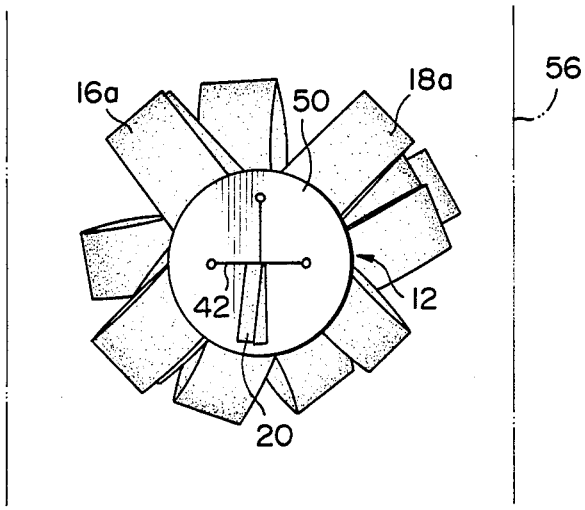

Further, as shown in FIG. 20, according to the embodiment of the ribbon in which only the pair of strings 20 is passed through the slit 42 of the tack plate 12, after forming the ribbon into the artificial flower, the artificial flower may be fastened to the article 56 by pressing one surface of the tack plate 12 against the article 56. At this time, part of the pair of strings 20 is adhered to part of the adhesive film 50 of the tack plate 12 and the remaining portion of the film 50 is adhered to the article 56. In this embodiment, since part of the pair of strings 20 is adhered to the surface 12*a* of the tack plate 12 in the state of bearing the other surface 12*b* of the tack plate 12 against the adhesive portion 24 which is located at the nearest portion to the other ends of the strips 16, 18, the relative movement between the strings 20 and the strips 16, 18 may not be produced. Also, in this embodiment, it is preferable to cut the pair of strings 20 at a proper position before or after the artificial flower is fastened to the article 56.

Obviously, many modifications and variations of the present invention are possible in light of the above teachings. It is therefore understood that the present invention may be practiced within the scope of the appended claims otherwise than as specifically described herein.

What is claimed is:

1. In combination, an artificial-flower-forming ribbon and a tack plate, comprising:

an artificial-flower-forming ribbon having a pair of strips overlapped with respect to each other and at least one string placed along and interposed between said strips, said at least one string being joined to one end of each of said strips at one end thereof, said strips being adhered to each other at at least two portions on each of a plurality of lines spaced apart in the longitudinal direction of said strips so as to permit relative movement of said strips and said at least one string interposed between said strips; and a tack plate including a first plate member having at least one slit or hole defined therein, through which both of said strips and said at least one string are passed, and a second plate member having adhesive films disposed on both surfaces thereof, said second plate member being joined to said first plate member and to one of said pair of strips passed through said slit or hole of said first plate member by one adhesive surface thereof, while said second adhesive surface of said second plate member permits said combination of said artificial-flower-forming ribbon and said tack plate to be secured to a support surface.

2. A combination of an artificial-flower-forming ribbon and a tack plate as claimed in claim 1, wherein said second plate member is made of an elastic material.

3. A combination of an artificial-flower-forming ribbon and a tack plate as claimed in claim 1, wherein a separable sheet is joined with the film provided on the second surface of said second plate member.

4. In combination, an artificial-flower-forming ribbon and a tack plate, comprising:

an artificial-flower-forming ribbon having a pair of strips overlapped with respect to each other and at least one string placed along and interposed between said strips, said at least one string being joined to one end of each of said strips at one end thereof, said strips being adhered to each other at at least two portions on each of a plurality of lines spaced apart in the longitudinal direction of said strips so as to permit relative movement of said strips and said at least one string interposed between said strips; and a tack plate including a plurality of slits or holes, of different lengths for accommodating different artificial-flower-forming strips or strings of different widths, through which both of said strips and said at least one string or only said at least one string are passed, and an adhesive film disposed upon one surface thereof for securing said tack plate to a support surface.

5. A combination of an artificial-flower-forming ribbon and a tack plate as claimed in claim 4, wherein said tack plate has a circular planar shape.

6. A combination of an artificial-flower-forming ribbon and a tack plate as claimed in claim 4, wherein said tack plate has a polygonal planar shape.

7. A combination of an artificial-flower-forming ribbon and a tack plate as claimed in claim 4, wherein:

two slits having different length dimensions respectively are disposed in a crossed relationship with respect to each other.

8. A combination of an artificial-flower-forming ribbon and a tack plate as claimed in claim 4, wherein:

each of said slits has a length which is smaller than the width of either one of said strips.

9. A combination of an artificial-flower-forming ribbon and a tack plate as claimed in claim 4, wherein:

said hole has a diameter which is smaller than the width of said at least one string.

10. A combination of an artificial-flower-forming ribbon and a tack plate as claimed in claim 4, wherein:

said one surface of said tack plate having said adhesive film applied thereto is disposed toward said one end of each of said strips.

11. A combination of an artificial-flower-forming ribbon and a tack plate as claimed in claim 4, wherein:

said one surface of said tack plate having said adhesive film applied thereto is disposed toward the other ends of said strips.

12. A combination of an artificial-flower-forming ribbon and a tack plate as claimed in claim 4, wherein:

a separable sheet is adhered to said film of said tack plate.

13. In combination, an artificial-flower-forming ribbon and a tack plate, comprising:

an artificial-flower-forming ribbon having a pair of strips overlapped with respect to each other and at least one string placed along and interposed between said strips, said at least one string being joined to one end of each of said strips at one end thereof, said strips being adhered to each other at at least two portions on each of a plurality of lines spaced apart in the longitudinal direction of said strips so as to permit relative movement of said strips and said at least one string interposed between said strips; and a tack plate including, a plurality of slits disposed in mutually orthogonally crossed directions with respect to each other so as to permit axial expansion of said crossed portions of said tack plate and thereby facilitate insertion and passage therethrough of both of said strips and said at least one string, or only said at least one string, and an adhesive film disposed upon one surface thereof for securing said combination of said artificial-flower-forming ribbon and said tack plate to a support surface.

14. The combination as set forth in claim 1, wherein:

said plurality of lines for adhering together said pair of strips are disposed at angles of 45° with respect to the longitudinal extent of said strips.

15. The combination as set forth in claim 1, wherein:

the distance between said plurality of lines adhering together said pair of strips gradually lengthens along the longitudinal extent of said strips.

16. The combination as set forth in claim 1, wherein:

said first plate member has a rectangular planar configuration.

17. The combination as set forth in claim 1, wherein:

said first plate member has an elliptical planar configuration.

18. The combination as set forth in claim 1, wherein:

said first plate member has a pentagonal planar configuration.

19. The combination as set forth in claim 4, wherein:

said plurality of slits are disposed parallel to each other.

20. The combination as set forth in claim 1, wherein:

said hole defined within said first plate member has the configuration of a semi-circle.

* * * * *